US005437575A

United States Patent [19]

Douglass, Jr.

[11] Patent Number: 5,437,575

[45] Date of Patent: Aug. 1, 1995

[54] BINGO METHOD OF SCORING BOWLING

[76] Inventor: John Douglass, Jr., 7907 Ridgemont Dr., Fair Oaks, Calif. 95628

[21] Appl. No.: 269,442

[22] Filed: Jun. 30, 1994

[51] Int. Cl.[6] ..... A63F 3/06

[52] U.S. Cl. ..... 473/54; 273/269

[58] Field of Search ..... 473/54, 65, 70; 273/139, 269, 270, 277

[56] References Cited

U.S. PATENT DOCUMENTS

| | | | |
|---|---|---|---|
| 235,209 | 12/1880 | Chambers . | |
| 917,060 | 4/1909 | Harrison . | |
| 1,357,778 | 11/1920 | Jacobs . | |
| 3,024,043 | 3/1962 | Lyman et al. | 281/8 |
| 3,534,963 | 10/1970 | Weimer | 273/135 |
| 3,618,952 | 11/1971 | Tallarida | 273/135 |
| 4,225,924 | 9/1980 | Trujillo | 473/65 |
| 4,323,240 | 4/1982 | Stewart et al. | 273/85 |
| 4,883,636 | 11/1989 | Fantle, Jr. | 273/269 |

*Primary Examiner*—Vincent Millin
*Assistant Examiner*—William M. Pierce
*Attorney, Agent, or Firm*—Bielen, Peterson & Lampe

[57] ABSTRACT

A game method utilizing a particular number of bowling pins that are set up in a formation which may be conventional to bowling. A bowling ball is directed at the bowling pins in order to topple the same. The topple bowling pins are transferred into a number which is indicated on a game board having a number of spaces, each with an assigned number. The spaces on the game board are arranged in a definite pattern. Successive placements of indicia on the game board are collated according to an arrangement forming a selected part of the game board pattern.

3 Claims, 1 Drawing Sheet

BINGO METHOD OF SCORING BOWLING

BACKGROUND OF THE INVENTION

The present invention relates to a novel and useful game method which is game of skill.

Bowling games have been played for centuries. The objective of bowling is to topple as many bowling pins as possible during the frames allotted and the number of rolls the balls permitted within those frames. It may be apparent that the best bowlers normally throw as many strikes or spares as possible in the shortest possible time.

Other variations of games employ boards or cards having a multiplicity of numbers in various spaces thereupon. For example, U.S. Pat. No. 3,618,952 shows a game board using a mathematical base system designed to teach the "new math". U.S. Pat. Nos. 2,352,209, 917,060, and 1,357,778 show a game apparatus using a bowling type arrangement and a board having a particular pattern which may be used separately from or in conjunction with the bowling game.

U.S. Pat. No. 3,024,043 describes a recording apparatus for a bowling scorer which provides a visual record of a bowling game.

U.S. Pat. No. 4,323,240 describes a bowling game which is used in conjunction with a color-coded score card. The coded numbers selected from the bin are placed on the score card which resembles a bowling score card.

U.S. Pat. No. 3,534,963 shows a bingo type game which is used in conjunction with a race result.

A game of skill which utilizes the game of bowling and a game board to provide unusual results would be a notable invention in the field of games.

SUMMARY OF THE INVENTION

In accordance with the present invention a novel and useful game method is herein provided.

The game method of the present invention utilizes a typical bowling arrangement in which a particular number of bowling pins are set in a formation on a bowling alley or surface. A bowling ball is directed at the bowling pins set up in this matter in order to topple a particular pin or a particular number of pins. Such number is obtained after the ball has been thrown or rolled through the pins.

The game board is also utilized in the present invention and is provided with a plurality of spaces, each having a number corresponding to any pin or any total of pins which may be toppled by the bowling ball. The spaces are arranged in a definite pattern on the game board. The number representing a particular pin toppled, a particular number of pins toppled or a particular combination of pins toppled according to their position is then transferred to the game board by an indicia which may be a mark or a token. Successive placements of indicia are then collated according to a plan or arrangement which forms a selected part of the game board or the entire game board.

It may be apparent that a novel and useful game method has been described herein.

It is therefore an object of the present invention to provide a game method which utilizes skill in bowling and coordination with such skill unto a game board.

Yet another object of the present invention is to combine bowling skills with portions of bingo-like game board for the purpose of entertainment.

Another object of the present invention is to provide a game method which permits persons having lesser bowling skills to compete more effectively with persons having high bowling skills.

The invention possesses other objects and advantageous as especially concerns particular characteristics and features thereof which will become apparent as the specification continues.

For a better understanding of the invention, references made to the following Detailed Description of the Preferred Embodiments thereof which will be referenced to the hereinabove described drawings.

DETAILED DESCRIPTION OF THE PREFERRED EMBODIMENTS

Figure 2:
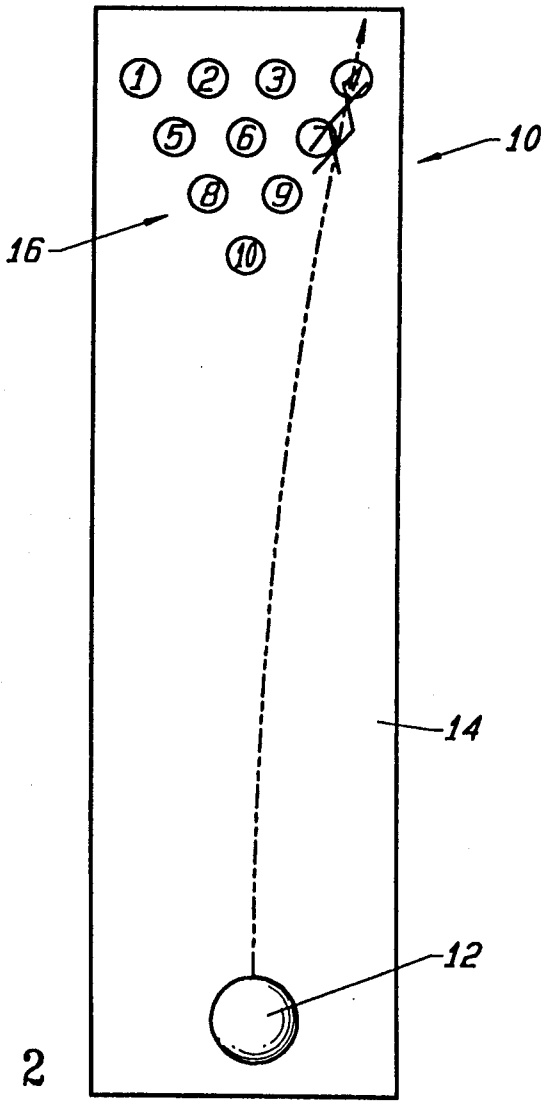
FIG. 2 represents a top plan view of a bowling ball and the schematic formation of bowling pins used in a bowling game and in conjunction with the game board of FIG. 1.
Figure 1:
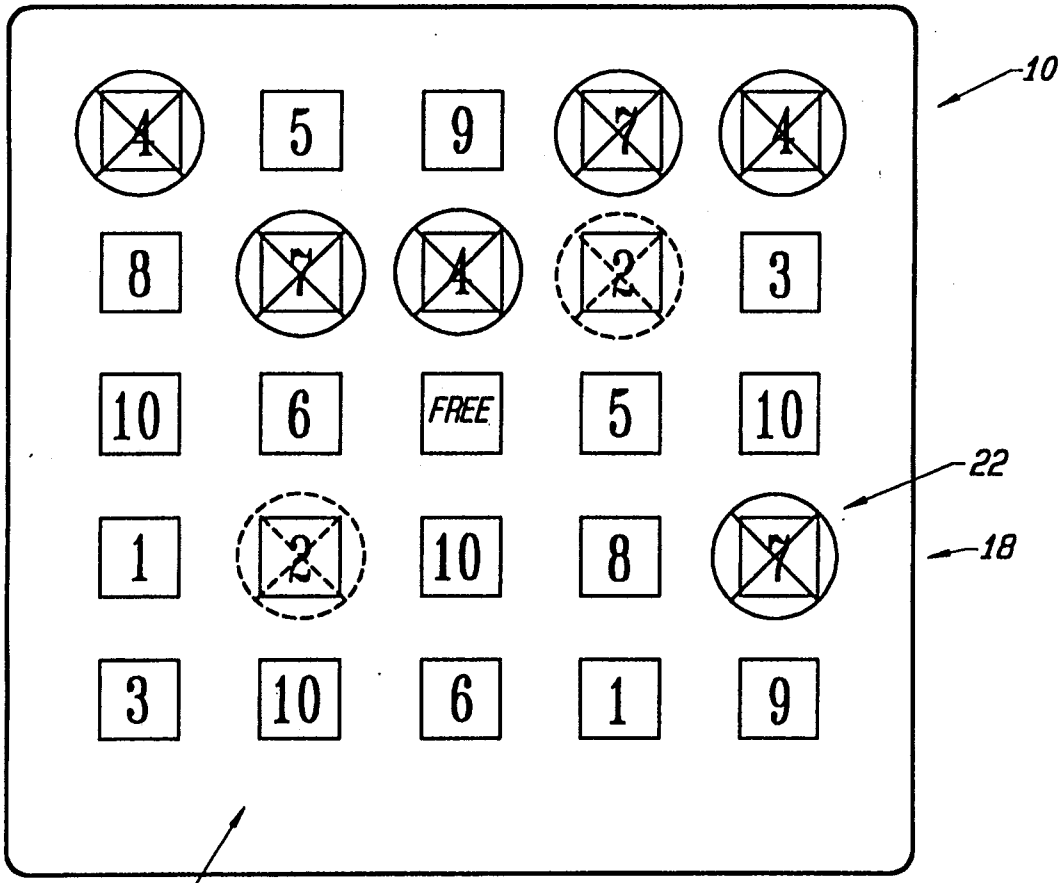
FIG. 1 is a top plan view of a game board used in conjunction with the bowling game depicted in FIG. 2.

The method of the present invention is depicted in FIGS. 1 and 2 by reference character 10. With reference to FIG. 2, it may be observed that a bowling ball 12 is used on a bowling surface 14, such as a bowling alley. A plurality of bowling pins 16 are shown on one end of the bowling surface, arranged in the normal 10-pin arrangement, with each pin carrying a number. In the normal manner, bowling ball 12 is rolled along bowling surface 14 to topple as many as possible of the ten pins depicted in FIG. 2.

FIG. 1 represents a game board 18 which may be formed of any rigid or semi-rigid material. Game board 18 includes a plurality of spaces 20 thereupon, each outlined in the form of a square. Each of the plurality of spaces carries a number corresponding to the numbered position of any one of the plurality of pins 16 or a summation of any combination of the pins which may be toppled by bowling ball 12 on FIG. 2. Indica 22 in the form of a circle with an X through the same can be used to identify the number obtained from the bowling game of FIG. 2. It should be noted that indicia 22 may take the form of a mark, a three-dimensional token, or any other item which is capable of identifying any of the squares 20 on FIG. 1.

In operation, the participants in the method of game 10 roll a bowling ball 12 along surface 14 to topple a particular pin of plurality of pins 16 or a particular number of pins 16. FIG. 2 represents that pins identified as 4 and 7 have been toppled by bowling ball 12. Thus, the numbers 4 and 7 may be transferred to game board 18 by plurality of indicia 22 as shown in solid line on FIG. 1. As an alternative, the numerical summation of pins 4 and 7, i.e., 2, may be transferred to game board 18. Such transfer is noted by the dash lines indicia on FIG. 1. The results of success of tossing of bowling ball 12 would eventually cover plurality of spaces 20 on game board 18 according to a predetermined plan or part of the pattern depicted in FIG. 1 For example, a diagonal, an "X" a square, all corners, or any other pattern that may be agreed upon as ending the game method 10. In addition, it may be agreed upon that the arrangement would be the covering of all the squares 20 on game board 18 resulting in the successful game completion of game method 10.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A game method of using a bowling surface including bowling pins and a bowling ball in combination with the steps of:

a. setting a particular number of bowling pins in a formation on the bowling surface;

b. repeatedly rolling the bowling ball along the bowling surface in an effort to contact and topple the bowling pins;

c. determining a particular number selectively representing a numeric assignment of each of the bowling pins topped with each roll of the bowling ball and noting the total number of pins toppled by each roll of the bowling ball;

d. providing a game board with a plurality of spaces each having a number corresponding to a possible particular number determined in said step of determining a particular number, said game board spaces being arranged in a particular pattern on said game board;

e. repeatedly placing an indicia on a space of said game board corresponding to each particular number determined in said step of determining a particular number; and f. collating said repeated placements of indicia on said game board according to an arrangement forming a selected portion of said game board pattern.

2. The game method of claim 1 in which said indicia is an object.

3. The game method of claim 1 in which said plurality of spaces each having a number include a multiplicity of said spaces having the same number.

* * * * *